United States Patent [19]

Tamai et al.

[11] 4,183,414

[45] Jan. 15, 1980

[54] PERCUSSION TOOL AND CARTRIDGE-TYPE OIL TANK THEREFOR

[75] Inventors: Tadashi Tamai; Takashi Kojima, both of Obama, Japan

[73] Assignee: Shibaura Engineering Works Co. Ltd., Tokyo, Japan

[21] Appl. No.: 874,407

[22] Filed: Feb. 2, 1978

[30] Foreign Application Priority Data

Feb. 4, 1977 [JP] Japan ..... 52-10765

[51] Int. Cl.[2] ..... E21C 3/00

[52] U.S. Cl. ..... 173/118; 184/64; 222/88; 173/DIG. 3

[58] Field of Search ..... 222/88, 81, 541; 173/116, 118, DIG. 3; 184/64, 102, 103 R, 1 R, 6.5, 14, 10, 19, 22, 25

[56] References Cited

U.S. PATENT DOCUMENTS

| | | | |
|---|---|---|---|
| 1,355,195 | 10/1920 | Van Orsdale | 222/88 UX |
| 1,615,581 | 1/1927 | Horns | 222/88 |
| 2,259,863 | 10/1941 | Smith | 222/88 |
| 2,637,336 | 5/1953 | Emery | 184/103 R |
| 2,717,661 | 9/1955 | Mayfield | 184/14 |
| 3,162,268 | 12/1964 | Short | 184/102 X |
| 3,376,939 | 4/1968 | Holzapfel | 173/116 |
| 3,847,248 | 11/1974 | Avery | 184/1 R |
| 3,994,412 | 11/1976 | Difiglio | 222/541 X |
| 4,077,492 | 3/1978 | Inoue | 184/64 |
| 4,088,246 | 5/1978 | Klingaman | 222/88 |

*Primary Examiner*—David H. Brown
*Attorney, Agent, or Firm*—Eric P. Schellin

[57] ABSTRACT

A pneumatic hammer, hammer drill or like percussion tool incorporating a cartridge-type oil tank detachably installed in the main body of the tool. The oil tank is made of transparent or semitransparent material and held from outside by a holding plate formed with at least one slit, permitting the user to check the tank from outside for an oil consumption. The oil tank is supported on a seat plate which is detachably mounted on the tool main body and which, when removed, enables the user to inspect or repair the interior with ease.

7 Claims, 14 Drawing Figures

PERCUSSION TOOL AND CARTRIDGE-TYPE OIL TANK THEREFOR

BACKGROUND OF THE INVENTION

This invention relates to percussion tools such as pneumatic hammers and hammer drills, and more particularly to a percussion tool incorporating an oil tank of the cartridge type by which the tool can be easily replenished with oil and which enables the user to readily ascertain the quantity of oil remaining in the tank.

Hammer drills for example for drilling concrete include a drill element adapted for rotation as well as for axial percussive oscillation by being repeatedly beaten on its inner end with a built-in hammer. Since the work is very hard, the hammer is reciprocated in repetition usually pneumatically by the combination of a piston and a cylinder. The sliding portion of the piston-and-cylinder means therefore requires a slight but continuous supply of oil.

For this purpose, conventional hammer drills have an oil reservoir provided in its main body for steadily lubricating the sliding portion. However, the operation of the hammer drill entails a considerable oil consumption, giving rise to the necessity of replenishing the oil reservoir relatively frequently. Use of a reservoir of increased capacity could lead to a less frequent replenishment, but the increased quantity of oil which must be wholly supported by the operator would burden the operator.

Hammer drills require due care during use against troubles such as the ingress of extreneous matter into the sliding or oscillating portion and wear on packings. Additionally the operator must check the tool for lubrication from time to time because when depleted of oil for one cause or another, the tool would be subject to serious troubles such as abnormal wear. Furthermore the oil applicator for lubricating the tool with its wick in contact with the crank for the piston is not always steadily serviceable over a prolonged period of time and requires frequent inspection for adjustment or repair. It is especially necessary that the interior of the reservoir be readily checkable for the quantity of oil to assure lubrication at all times.

SUMMARY OF THE INVENTION

An object of this invention, which has been accomplished in view of the foregoing problems, is to provide a percussion tool which incorporates a detachable oil tank of the cartridge type and which can be easily replenished with oil by the replacement of the oil tank.

Another object of this invention is to provide a percussion tool incorporating a cartridge-type oil tank made of transparent or semitransparent synthetic resin and held by a holding plate from outside, the holding plate being formed with at least one slit extending longitudinally of the tool main body, so that the user is able to readily ascertain from outside the quantity of oil remaining in the tank.

Another object of this invention is to provide a percussion tool incorporating a cartridge-type oil tank supported on a detachable seat plate to render the oil applicator portion easy to inspect and repair and enable the user to confirm the state of lubrication.

The cartridge-type oil tank of this invention is thus replaceable and is handled independently of the tool main body, so that the oil outlet of the tank needs to be sealed, but if the oil outlet is capped, the cap must be removed before the tank is installed into the tool main body. Further if the wick for feeding the oil in contact with the crank on the piston is adapted to be held to the tool main body, the oil tends to leak when the outlet is turned down for the installation of the tank. The wick, when fitting in and retained by the outlet, would prevent such leakage, but the wick would not always be held exposed by a specified length, necessitating a cumbersome procedure for the adjustment of the length.

Accordingly another object of this invention is to provide a percussion tool adapted to be equipped with an oil tank as supported on a seat plate in the tool main body, the seat plate having an outwardly projecting tubular inlet formed by burring and sharpened at its outer end as by drilling, the tubular inlet holding a wick therein and adapted to puncture part of the oil tank, whereby the oil tank is rendered readily installable into the main body free of any oil leakage without the necessity of adjusting the length of the wick.

As already stated, oil applicators for lubricating tools with a wick held in contact with the crank of the piston are not always steadily serviceable over a prolonged period of time and require frequent inspection and adjustment or repair. Furthermore excessive application of the oil will result in an increased oil consumption, necessitating more frequent replenishment and leading to an increased cost, whereas with an insufficient quantity of oil present, the sliding portion will not be fully lubricated. It is therefore required that the oil be applicable at a readily adjustable rate. Supposedly the supply of oil is adjustable by altering the exposed length of the wick. With the oil applicator of the type described, however, the wick, when exposed by a greater length, will come into increased contact with the crank and will be worn away more markedly, whereas with too short an exposed length, there is the likelihood that the exposed end of the wick will not contact the crank, hence undesirable.

Accordingly another object of this invention is to provide a percussion tool incorporating an oil applicator wick with opposite ends of different thicknesses which is reversibly inserted in place to render either one of the ends alternatively serviceable as the exposed end and to thereby facilitate the adjustment of the supply of oil without varying the exposed length of the wick.

Still another object of this invention is to provide an oil tank of the cartridge type having a tubular oil outlet portion projecting from the tank and heat-sealed at its outer end, the tubular outlet portion being formed in its outer periphery with a separation line along which the outer end can be easily removed for the installation of the tank in the tool main body while rendering the tank free of any oil leakage during transport and storage.

Other objects of this invention will become apparent from the following description with reference to the accompanying drawings.

DETAILED DESCRIPTION OF THE INVENTION

Figure 1:
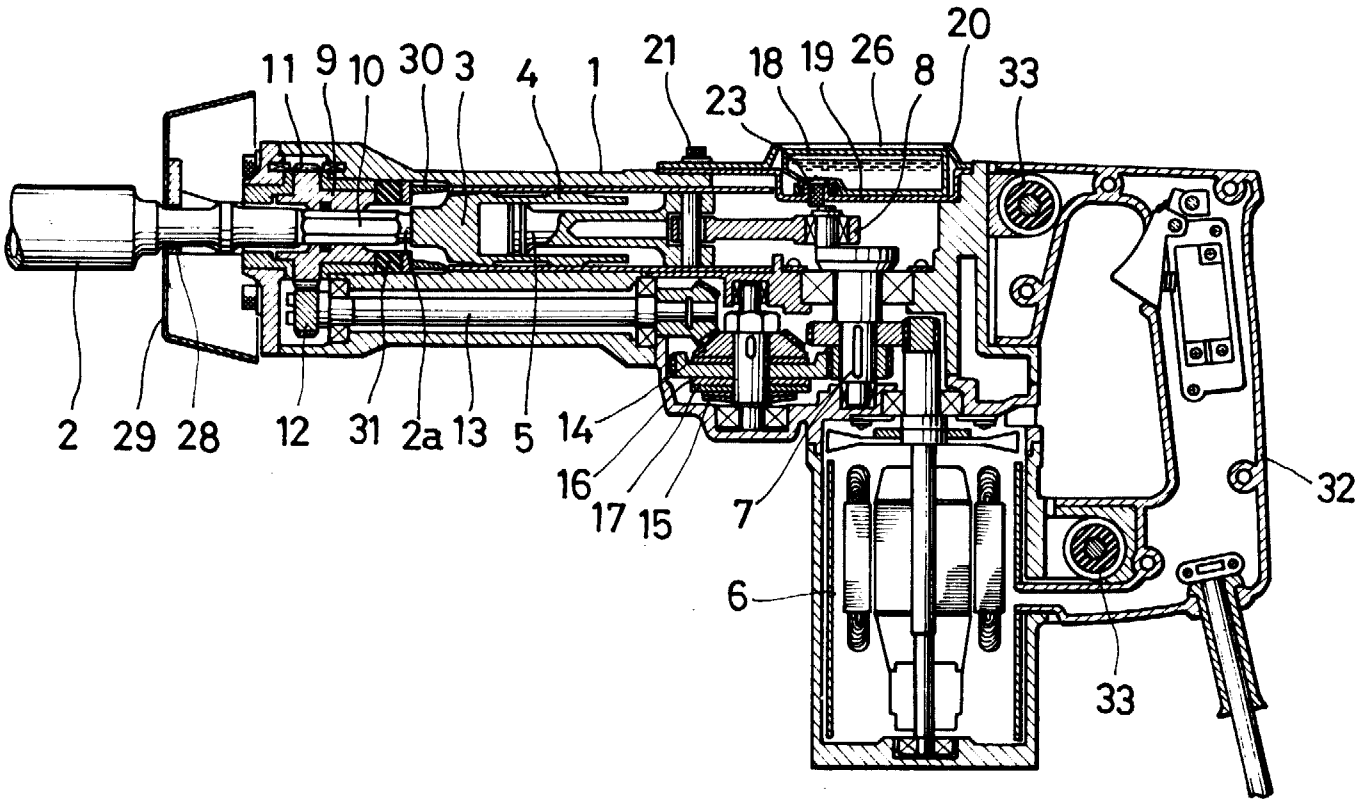
FIG. 1 is a view in vertical section showing an embodiment of this invention.

Embodiments of this invention will be described below with reference to the drawings.

FIGS. 1 to 7 show an embodiment including a tool main body 1 holding at its forward end a drill 2 which is projectable and retractable. The tool main body 1 houses a slidable striker 3 for repeatedly beating the inner end 2*a* of the drill 2. The striker 3 is integral with a cylinder 4 having a piston 5 fitting therein for giving an increased internal pressure. The piston 5 is connected to a crank 8 turnable by a motor 6 through a shaft 7. The crank 8, when turned, repeatedly increases the pneumatic pressure within the cylinder 4 to drive the striker 3.

The tool main body 1 also houses in its forward end a rotatable holder 9 for the drill 2. The holder 9 has a hexagonal bore through which a hexagonal shank portion 10 of the drill 2 at its inner end loosely extends so as to be rotatable with the holder 9 and slidable axially thereof. The holder 9 has a toothed outer periphery to provide a gear 11 meshing with a gear 12. The holder 9 is coupled to the shaft 7 for driving the crank 8 by way of the gear 12, a shaft 13, bevel gear means 14 and frictional power transmitting means 17 comprising dishlike springs 15 and a friction plate 16 and adapted to effect idle rotation under an overload. The holder 9 is therefore rotatable simultaneously when the striker 3 repeatedly beats the drill 2 to rotate the drill 2 while the drill 2 is being oscillated axially thereof. When the drill used has a round shank portion loosely fitting in the hexagonal bore of the holder 9, the drill will not rotate despite the rotation of the holder 9. The tool will then be usable as a hammer adapted for oscillation only.

The percussion tool is detachably equipped with an oil tank 18 of the cartridge type disposed close to the crank 8 housed in the main body 1. The oil tank 18 is made of transparent or semitransparent synthetic resin and filled with a lubricant. The tool main body 1 has an opening providing an oil tank accommodating portion 18'. A seat plate 19 is provided in the portion 18' with the oil tank 18 received in its recessed portion. The oil tank 18 is held from outside by a holding plate 20, which is fastened to the tool main body 1 by a screw 21 along with the seat plate 19. Thus the oil tank 18 is detachably mounted on the main body 1 by the detachable holding plate 20. Alternatively the seat plate 19 may be attached to the main body 1 independently of the holding plate 20. The oil tank 18 can be made detachably installable by rendering the holding plate 20 detachably mountable by some other means as by a hinge connection.

Figure 4:
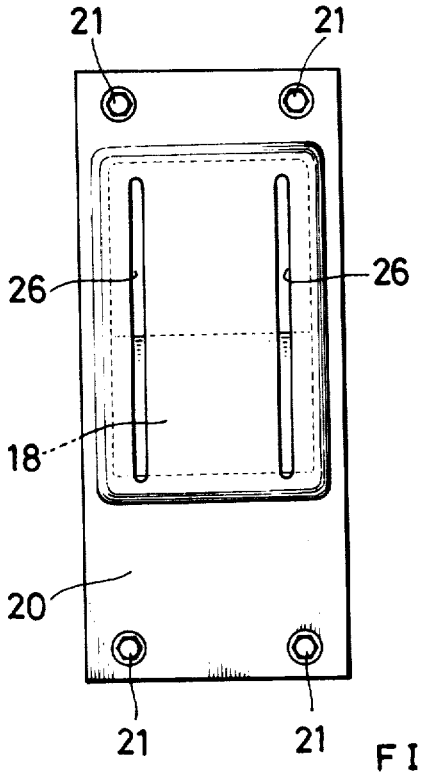
FIGS. 4 to 6 are views of tank holding plates of different constructions.
Figure 5:
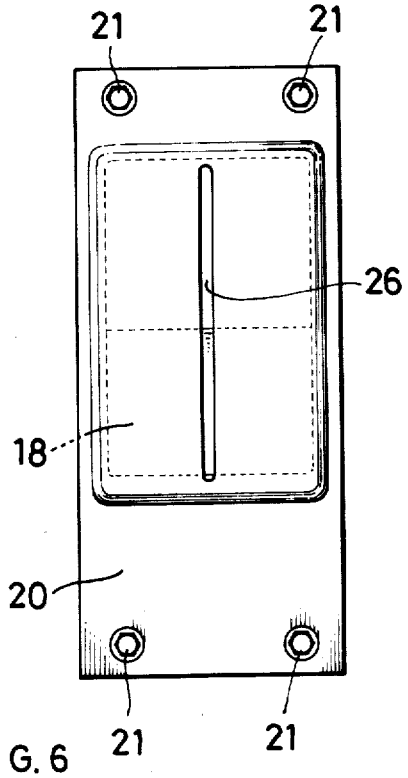
Figure 6:
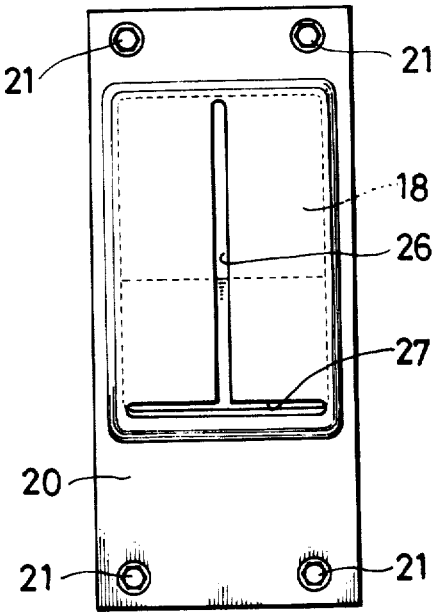

According to the present invention, the holding plate 20 for holding the oil tank 18 from outside is formed with at least one longitudinal slit 26 where the plate 20 is in pressing contact with the oil tank so as to enable the user to ascertain from outside the quantity of oil within the tank 18. Two parallel slits 26 may be formed as shown in FIG. 4, or only one center slit 26 may be provided as seen in FIG. 5. The longitudinal center slit 26 can be formed in combination with a lower transverse slit 27 in an inverted T-shaped arrangement as illustrated in FIG. 6. Especially with the arrangement of FIG. 4 or 6, the oil quantity, if very small, can be confirmed even when the tool is in an inclined position.

Indicated at 28 is a retainer for the drill 2, at 29 a dustproof cap, at 30 a catching collar engageable with the striker 3 to prevent the idle blow of the striker 3, at 31 a shock absorber made of hard rubber such as so-called "iron rubber" for mitigating the impact of the engagement, at 32 a handle, and at 33 shock absorbing rubber members provided between the handle 32 and the tool main body 1.

With the construction described above, the rotation of the motor 6 turns the crank 8 and brings the piston 5 into reciprocation, causing the striker 3 to pneumatically follow the motion of the piston 5 to repeatedly beat the inner end 2*a* of the drill 2. Simultaneously, the motor 6 rotates the holder 9 for the drill 2, causing the drill 2 to rotate therewith while in oscillation to drill concrete or like work.

An oil absorbent wick 23 extends from the oil tank 18 and is held in contact with the crank 8. During the operation described above, the wick which is impregnated with the oil from the tank 18 applies the oil to the crank 8, which in turn spatters the oil in the form of mist, thus lubricating the cylinder 4 and the sliding portion of the piston 5.

In this way, the oil within the tank 18 is continuously fed to the interior of the tool main body and progressively consumed during the operation of the percussion tool. When the oil tank is depleted of oil, there arises the need for a fresh supply of oil, which can be provided, according to this invention, by detaching the oil tank holding plate from the tool main body and replacing the oil tank with a new oil-containing tank.

According to the present invention in which a detachable oil tank of the cartridge type is used, the tool can be easily replenished with oil by the simple procedure of replacing an empty tank with a new one which is prepared for the supply of oil without interruption. Additionally the provision of the detachable seat plate 19 for the oil tank enables the user to inspect or repair the oil applicator portion, to adjust the wick or to confirm the state of lubrication with great ease during the replacement of the oil tank. Since the consumption of the lubricant is substantially proportional to the amount of work performed, the oil applicator portion can be inspected periodically. This assures a great advantage in the maintenance of the tool.

Further according to this invention, the oil tank is made of transparent or semitransparent synthetic resin and is adapted to be held from outside by a holding plate which is formed with at least one vertical slit, so that the user can ascertain through the slit the quantity of oil within the tank at any time when the tool is placed in the same upright position as during operation (see FIG.

7). The oil consumption thus confirmed will tell the user when to prepare a new oil tank. The construction described therefore provides a great convenience in the maintenance of the tool equipped with a cartridge-type oil tank.

Especially the holding plate having two parallel vertical slits clearly shows the quantity of oil within the tank if it is very small or even if the oil remains only in one corner of the tank as observed with the tool in a somewhat tilted position. This serves to eliminate the waste of oil which would result if the oil tank is replaced before being completely emptied.

The holding plate also serves to protect the synthetic resin oil tank from coarse fragments of concrete or like work since the slit or slits are limited in dimensions and intended solely for the observation of the quantity of oil.

Figure 2:
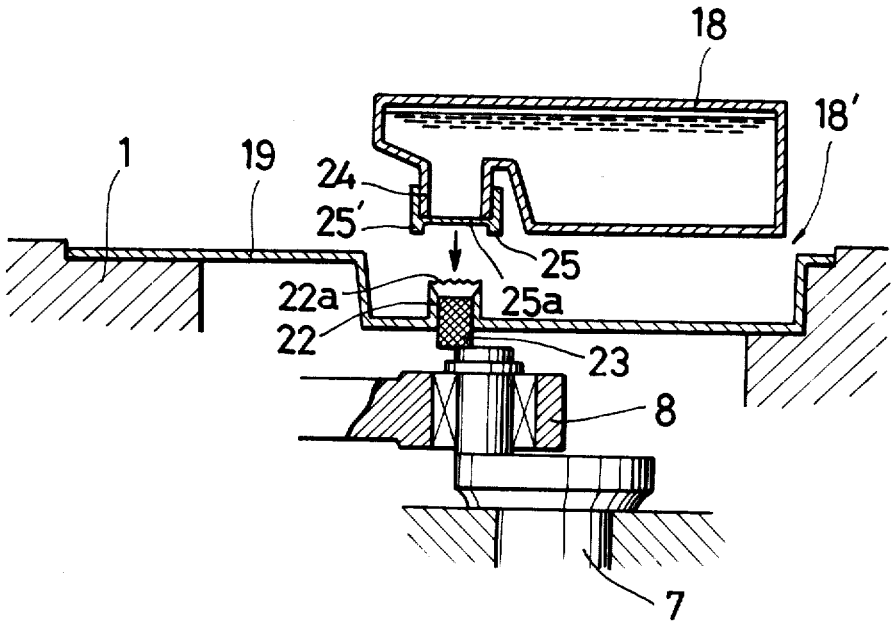
FIG. 2 is a fragmentary enlarged view in section showing an oil tank immediately before it is installed in place.
Figure 3:
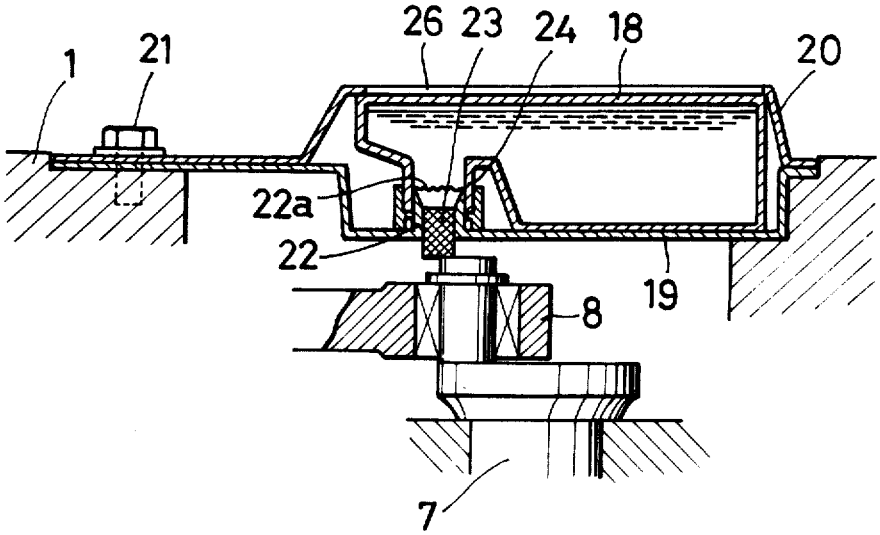
FIG. 3 is a view similar to FIG. 2 and showing the oil tank as installed in place.

As is best shown in FIGS. 2 and 3, the seat plate 19 has an outwardly projecting tubular inlet 22 formed by burring and having a top end 22*a* jagged by burring. The jagged top end 22*a* is further sharpened as by reaming with a conical tool such as a countersink. The wick 23 inserted in the tubular inlet 22 and adapted for contact at its one end with the crank 8 is held by the inlet. The wick 23 has such a length that the other end thereof is positioned slightly inward from the top end 22*a* of the tubular inlet 22, thus permitting the top end 22*a* to project above the wick 23. The top end 22*a* punctures part of the oil tank 18 when the tank is installed in place.

As illustrated, the oil tank 18 is formed, on its one side for contact with the seat plate 19, with a tubular oil outlet portion 24 fittable around the tubular inlet 22 and provided with a cap-shaped seal member 25 over the outer end thereof. The oil outlet portion 24 covered with the seal member 25 is forced against the tubular inlet 22 on the tool main body 1 in fitting engagement therewith, thereby causing the outer end 22*a* of the tubular inlet 22 to puncture the planar portion 25*a* of the seal member 25, whereby the oil tank 18 can be mounted on the main body 1 with its oil outlet opened. The planar portion 25*a* of the seal member 25 has a small thickness or is made from material which can be punctured with a sharp edge. The planar portion 25*a* of the seal member 25 may be provided with a peripheral rim 25' projecting axially of the oil outlet portion 24 as illustrated. The rim 25' will then assist the oil outlet portion 24 in fitting around the tubular inlet 22, consequently facilitating the installation of the oil tank 18.

The oil outlet portion 24 of the oil tank 18 and the planar seal portion 25*a* may be of some other construction; for example, the planar seal portion may be made integral with the oil outlet portion, in which case the tank is mountable in the same manner as above if the planar seal portion has a suitable thickness for the tubular inlet 22 to puncture the seal portion.

For replacement, the cartridge-type oil tank is mountable on the tool main body with extreme ease in the manner described above, namely by being pushed into place. Because the tank is installable with its oil outlet portion sealed, oil will not flow out from the tank when the oil outlet portion is turned down. Moreover the oil outlet portion is fittable to the tubular inlet simultaneously with the puncture of the sealed outlet portion by the tubular inlet without entailing any oil leak during the installation of the tank. Thus the tank is mountable on the tool main body free of any oil leakage in whatever position the main body may be placed. The construction in which the wick is held in the tubular inlet for contact with the crank not only eliminates the necessity of fitting the wick to the tank outlet portion every time the tank is attached to the tool main body but also permits the user to install the tank without handling or otherwise touching the wick, thus leaving the wick intact as adapted for contact with the crank in the specified position. With this construction, on the other hand, the wick is easily adjustable to the desired length and is readily replaceable when worn away.

Figure 8:
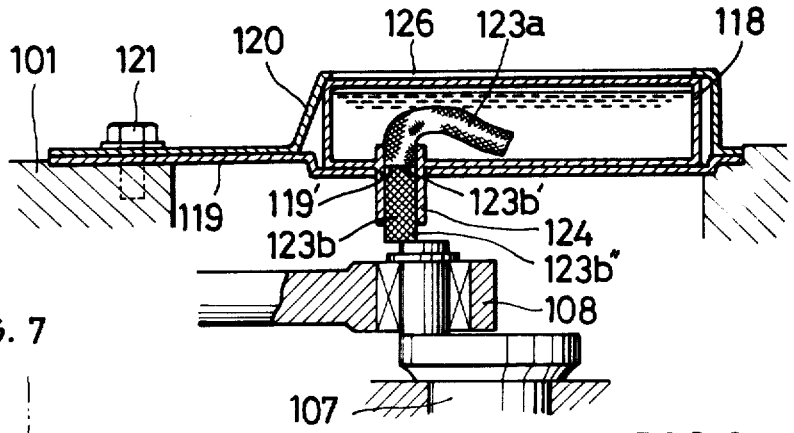
FIG. 8 is a fragmentary enlarged view in section showing another embodiment.
Figure 7:
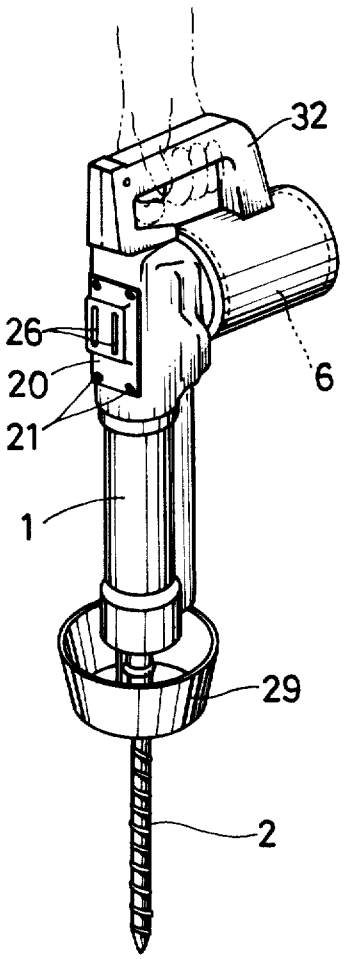
FIG. 7 is a perspective view showing a tool during use.
Figure 9:
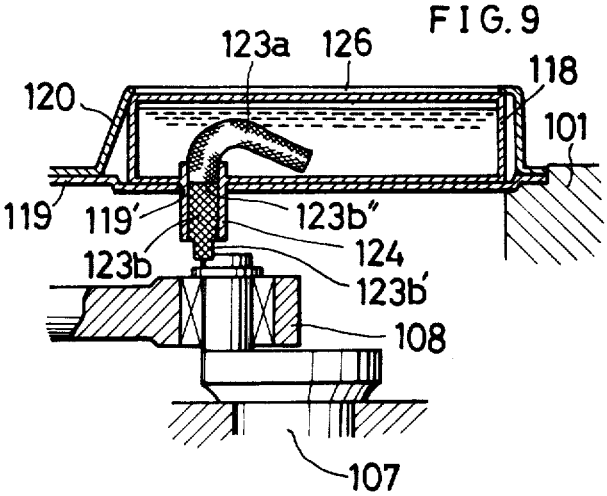
FIG. 9 is a view similar to FIG. 8 and showing the exposed wick of FIG. 8 as inverted and reinserted in place.
Figure 10:
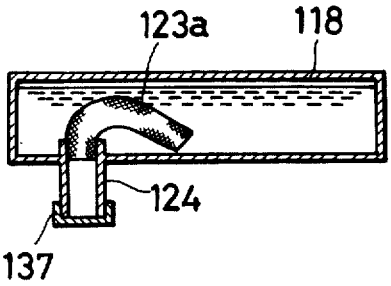
FIG. 10 is a view in section showing an oil tank for use in the embodiment of FIGS. 8 and 9.

Alternatively the oil applicator wick can be inserted in and held by the tubular oil outlet portion of the tank. FIGS. 8 to 10 show an embodiment comprising an oil tank 118 having a tubular oil outlet portion 124 which is fittable in an opening 119' formed in a seat plate 119. The oil outlet portion 124 holds as inserted therein an oil absorbent wick 123*a* extending into the tank and another oil absorbent wick 123*b* having an exposed outer end, the wicks 123*a* and 123*b* being in end-to-end contact with each other. The exposed wick 123*b* has opposite ends 123*b'* and 123*b''* of different thicknesses and is reversibly inserted into the outlet portion 124 for the adjustment of the supply of oil.

Since the cartridge-type oil tank 118 is transported and stored separately from the percussion tool for replacement purposes, the outer end of the oil outlet portion 124 may be capped with the two wicks 123*a* and 123*b* held inserted therein. Alternatively the oil outlet portion 124 may be sealed with a cap 137 with the inner wick 123*a* only held inserted in place as shown in FIG. 10 so that the outer wick 123*b* may be inserted into the outlet portion 124 immediately before the installation of the tank 118 in the tool main body 1. The two wicks 123*a* and 123*b* can of course be inserted into position when the tank is to be mounted on the tool main body 1. When inserting the wick 123*b* into the oil outlet portion 124, the smaller end 123*b'* is left exposed if an increased seepage, i.e. an increased supply, of oil appears likely, whereas if the seepage of oil is less than is desired, the greater end 123*b''* will serve as the exposed end.

For instance, when affording an excess of oil with the thick end 123*b''* exposed, the wick 123*b* will be inverted and reinserted in position to expose the thin end 123*b'*, through which the oil can be fed at a reduced rate. In the event of insufficient lubrication due to the use of the thin end 123*b'* as the exposed end, the wick 123*b* can be inverted to give an increased oil supply.

Since the outer wick 123*b* is held in the oil outlet portion 124 in end-to-end contact with the wick 123*a* extending into the tank, the inversion of the wick 123*b* produces no difference in the length of the exposed end, permitting the crank 108 to spatter the oil seeping through the wick free of any trouble.

FIGS. 11 to 14 show still another modified oil tank 218 in the form of a substantially flat rectangular prism in its entirety. A tubular oil outlet portion 224 of required length projects from one side of the tank 218 which side is to be supported on the seat plate on the tool main body. A lubricant is injected into the tank through the outlet portion 224 to fill the tank. An oil absorbent wick 223 made of felt or the like is inserted into and held by the oil outlet portion 224, with the inner end of the wick extending into the tank. With the wick thus fitted in place, the top end 224*a* of the oil outlet portion 224 is pressed on the opposite si 'es to a flat form with application of heat and is thereby closed. A circumferential separation line 244 is formed in the outer periphery of the closed tubular outlet portion 224. The top end 224*a* is therefore separable along the line 244.

Figure 11:
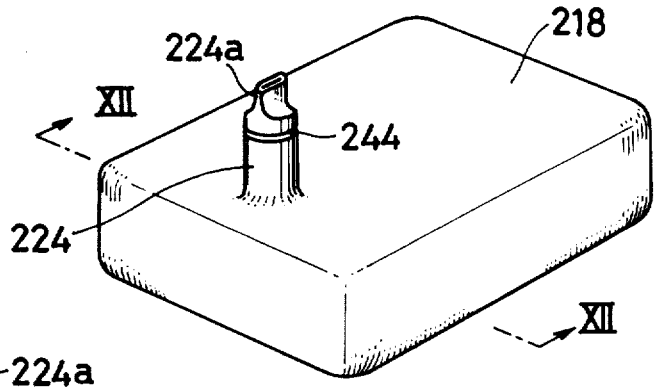
FIG. 11 is a perspective view showing a modified oil tank.
Figure 12:
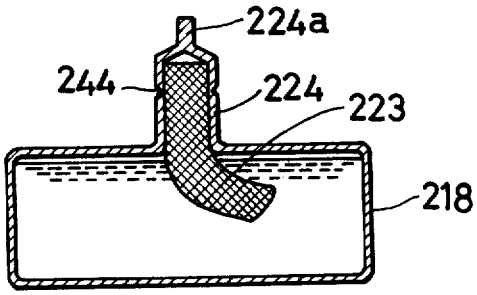
FIG. 12 is a view in section taken along the line XII—XII in FIG. 11.
Figure 13:
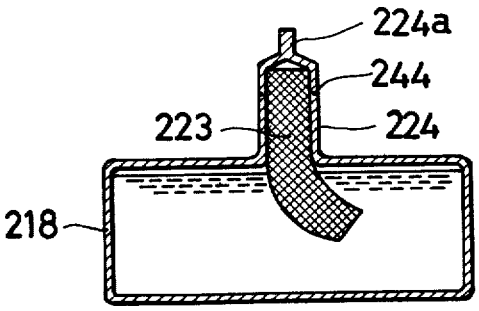
FIG. 13 is a sectional view showing a modification of the oil tank of FIG. 11.
Figure 14:
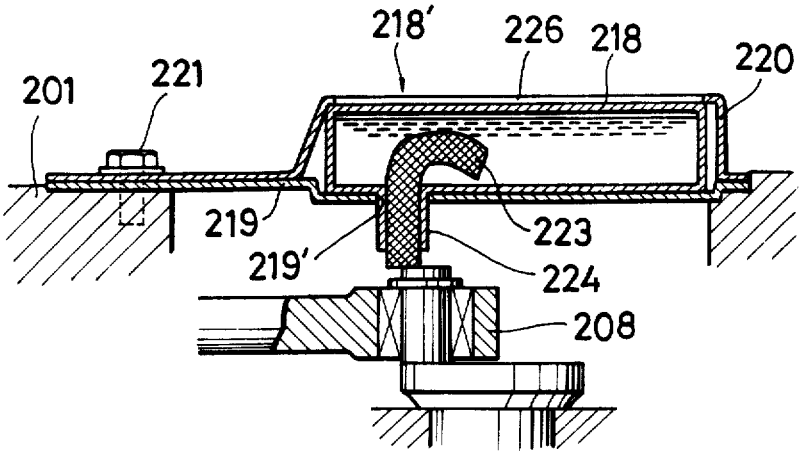
FIG. 14 is a view partly broken away to show the oil tank of FIG. 11 as installed in the main body of a tool.

The separation line 244 may be in the form of a V-shaped groove as seen in FIGS. 11 and 12 to reduce the wall thickness of the outlet portion 224, or may be in the form of an incision as seen in FIG. 13. As is illustrated, the separation line 244 is so positioned that when the top end 224*a* of the outlet portion 224 is removed, the end portion of the wick will be exposed to some extent while allowing the remainder of the outlet portion 224 to have a suitable length as an oil outlet. The wick 223 can be inserted in place after the top end 224*a* has been removed.

Instead of closing the top end 224*a* of the oil outlet portion 224 by flattening the end, the top end 224*a* can be closed as by being radially inwardly squeezed with application of heat and pressure, but when closed to a flat form as described above, the top end can be nipped and separated with greater ease, hence desirable. The tubular oil outlet portion 224 can be tapered toward its top end.

To mount the modified oil tank on the tool main body, the top end 224*a* of the oil outlet portion 224 of the tank 218 is separated off at the separation line 244 by nipping the top end and twisting or bending the end portion. If the oil tank 218 has the wick 223 already fitted therein, the exposed length thereof is then adjusted; otherwise the desired wick will be inserted into place.

The oil tank, which contains oil as completely sealed off, can be handled free of any leakage. Especially because the top end is closed in the form of an integral portion by the fusion of resin to itself with the application of heat and pressure, the closed portion will withstand impact or shake which would loosen a cap-like closure. The oil tank is therefore advantageous to transport or store.

The V-shaped groove or incision formed in the tubular outlet portion circumferentially thereof as a separation line renders the top end of the outlet portion removable with extreme ease as by twisting for the installation of the tank in the tool main body, notwithstanding that the top end has been closed by heating and pressure. Accordingly the tubular portion is very easy to open to provide an oil outlet.

When the oil tank has an oil applicator wick fitting in the tubular outlet portion, it is readily mountable on the tool main body without the necessity of inserting the wick into the outlet portion immediately before the installation.

Additionally the closure for the oil outlet, which is integral with the tubular outlet portion and the tank main body, is easy to make.

The percussion tools embodying this invention are not limited to hammer drills but include pneumatic hammers and like tools incorporating a piston for driving a striker. These embodiments all have the same features and advantages as described above.

What is claimed is:

1. A percussion tool comprising a tool main body holding at its forward end a tool bit which is projectable and retractable, a slidable striker housed within said tool main body for beating the inner end of said tool bit, said striker being integral with a cylinder having a piston fitting therein for giving an increased internal pressure, and crank means connected to said piston and turnable by drive means, wherein said crank means, when turned, brings said piston into reciprocation thereby repeatedly varying the pneumatic pressure within said cylinder to cause said striker to follow the motion of said piston to repeatedly beat the inner end of said tool bit, said percussion tool further characterized in that an oil tank of the cartridge type is detachably installed in the main body of the tool, and an oil absorbent wick extends from said oil tank and is held in contact with said crank.

2. A percussion tool as defined in claim 1 wherein the percussion tool further comprises a seat plate disposed in the tool main body for supporting the oil tank thereon, the seat plate having an outwardly projection tubular inlet formed by burring and sharpened at its outer end, the tubular inlet holding the wick therein and adapted to puncture part of the oil tank for the installation of the oil tank.

3. A percussion tool as defined in claim 1 wherein said oil tank further comprises a tubular oil outlet portion, the oil outlet portion holding as inserted therein an oil absorbent wick partly extending into the oil tank and another oil absorbent wick in end-to-end contact with the wick and having opposite ends of different thicknesses and being reinsertable into the oil outlet portion in its inverted position.

4. A percussion tool as defined in claim 1 wherein said crank means contacts said wick during each turn of said crank, whereby oil is fed to said crank means by said wick and whereby oil is fed in the form of a mist by spattering from said crank means to said striker, cylinder and piston.

5. A percussion tool as defined in claim 1 wherein the oil tank is made of transparent or semitransparent material and held from outside by a holding plate attached to the tool main body, the holding plate being formed with at least one slit extending longitudinally of the tool main body.

6. A percussion tool as defined in claim 5 wherein the holding plate is formed with a plurality of parallel slits.

7. A percussion tool as defined in claim 5 wherein the tool main body has an opening provided with a seat plate for supporting the oil tank thereon.

* * * * *